United States Patent [19]

Kwasnoski et al.

[11] 4,039,349

[45] Aug. 2, 1977

[54] METHOD AND APPARATUS FOR MULTI-STAGE RINSING

[75] Inventors: Daniel Kwasnoski, Hellertown; Vernon B. Mancke, Bethlehem, both of Pa.

[73] Assignee: Bethlehem Steel Corporation, Bethlehem, Pa.

[21] Appl. No.: 658,787

[22] Filed: Feb. 17, 1976

[51] Int. Cl.² ..... A47L 25/00

[52] U.S. Cl. ..... 134/10; 134/15; 134/60; 134/64 R; 134/122 R

[58] Field of Search ..... 134/10, 15, 60, 64 R, 134/122 R

[56] References Cited

U.S. PATENT DOCUMENTS

| | | | |
|---|---|---|---|
| 1,397,846 | 11/1921 | Walker | 134/60 |
| 1,462,734 | 7/1923 | Blakeslee | 134/125 |
| 2,418,386 | 4/1947 | Wood | 134/99 |
| 2,698,628 | 4/1948 | Zademach et al. | 134/112 |
| 3,022,203 | 2/1962 | Mains et al. | 134/15 |
| 3,034,933 | 5/1962 | Richards | 134/28 |
| 3,938,214 | 1/1974 | Hodsden et al. | 134/60 X |

*Primary Examiner*—Arthur D. Kellogg

*Attorney, Agent, or Firm*—Joseph J. O'Keefe; Charles A. Wilkinson

[57] ABSTRACT

The efficiency of a multi-stage rinsing operation is improved by routing a substantial portion or all of the overflow rinse liquor from the collecting tank of one stage directly to the spray rinse of the next succeeding stage along with rinse liquor from said succeeding stage. Improved cleanliness of the rinse liquor at each rinse stage is thereby attained while maintaining a self-regulating rinse system.

5 Claims, 4 Drawing Figures

METHOD AND APPARATUS FOR MULTI-STAGE RINSING

BACKGROUND OF THE INVENTION

Steel products such as sheet, strip, plate, strand, coils of rod or wire or other manufactured pieces such as, for example, machined pieces and the like must frequently be chemically treated either in conjunction with other operations, such as heat treating or forming, or as a separate operation during manufacture of a finished product. The pickling of steel products to remove surface oxides is a typical example of such chemical treatment. Pickling involves the application to the steel of aqueous solutions containing corrosive chemicals, typically sulfuric acid or hydrochloric acid, broadly referred to hereafter as process materials. After such treatment is completed, the process materials must be removed from the steel surface quickly and efficiently in order to produce an acceptable product for sale or to prevent interference either by the process materials themselves or their residual corrosive effects with subsequent treatment steps.

It has been common practice to remove such process materials from steel workpieces by immersion or spray-rinsing of the steel. Sometimes the process materials have been removed by initially spraying the workpiece with fresh water and then dunking the workpiece in a tank of rinse liquid. This is commonly known as the spray and dunk system. Removal of the process materials has also frequently been accomplished in a multi-stage countercurrent rinsing apparatus. Such rinsing apparatus is generally composed of a series of interconnected rinsing stations. Each station is equipped with a collecting tank, at least one spray head, and pumping means connecting the tank to the spray head. In addition, the series of tanks are interconnected so that excess rinse liquid in one tank will flow into the next succeeding tank in the series. The flow of rinse liquid from tank to tank is countercurrent to the path of travel of the workpiece being cleaned through the rinsing apparatus. In operation, rinse liquid in each collecting tank is pumped from the tank to the associated spray head or heads of that tank where it is sprayed down on the moving steel workpiece from which it then falls back into the collecting tank. Any excess rinse liquid in the tank, which liquid contains a portion of the process material rinsed from the workpiece, overflows into the collecting tank in the next rinsing stage or station where it mixes with the liquid already in this succeeding tank. A portion of this mixture of liquids is then pumped to the spray heads at that rinse station and the process repeated. By using such an arrangement rinse liquid is conserved by virtue of the reuse of the successively more contaminated rinse water at each successive rinse station. The workpiece is rinsed initially with the most contaminated rinse liquid and ultimately in the last stage or station with the least contaminated solution or fresh rinse solution. This prior arrangement improves rinsing efficiency while using a minimum amount of rinse liquid. It also provides an easily controllable rinse process in which the rinse liquid throughout the system merely overflows from tank to tank and no complicated control system is necessary to coordinate the levels and rinse volumes in each successive rinse stage.

Despite the aforementioned benefits which arise from use of such a multi-stage rinser, the rinse arrangement as presently known still has certain drawbacks and there is a need for an even more efficient multi-stage rinser which will provide either equivalent cleanliness of the workpieces while using a smaller volume of fresh rinse liquid or an increased cleanliness of the workpieces when using an equivalent volume of fresh rinse liquid.

Herein the terms "preceding" and "succeeding" are used to refer to locations using the direction in which rinse liquid flows through a multi-stage rinse apparatus as a reference as opposed to the direction of movement of the workpiece through the apparatus. Thus, the term preceding refers to a location upstream of the rinse liquid flow, and the term succeeding refers to a location downstream of the rinse liquid flow with respect to any initially established location. For example, a first rinse station in which a workpiece is initially treated or rinsed will be called a succeeding rinse station, while a second rinse station in which the workpiece is then treated as it passes countercurrently with respect to the rinse liquid flow in the system will be called a preceding rinse station.

SUMMARY

It has been discovered that by directly using a substantial portion or all of the overflow rinse liquid from the collecting tank of a preceding rinse stage as a portion of the liquid supplied to the spray head of the next succeeding rinse stage along with rinse liquor from said succeeding rinse stage, it is possible to reduce the amount of process material contained in the rinse spray at each intermediate stage. This reduction of process material allows a reduction in the volume of fresh rinse liquid used in the rinsing operation, while, at the same time, attaining the same degree of cleanliness in the final rinsed product and retaining the desirable self-regulating characteristics of the presently used arrangements. In some cases even a greater degree of cleanliness may be obtained while using a lesser amount of fresh rinse liquid. Alternatively a significantly increased degree of cleanliness can be obtained using the same amount of fresh rinse liquid and the same number of rinse steps.

In accordance with the invention a significant or major portion or all of the overflow rinse liquid from a preceding rinse station is routed more or less directly to the spray head or heads at the next rinse station prior to mixing with the liquid already present in the rinse tank in the next station and only that amount of liquid necessary to make up the fluid demand of the pump is drawn from the collecting tank of this next rinse station and directed to the spray head or heads.

DETAILED DESCRIPTION

Figure 1:
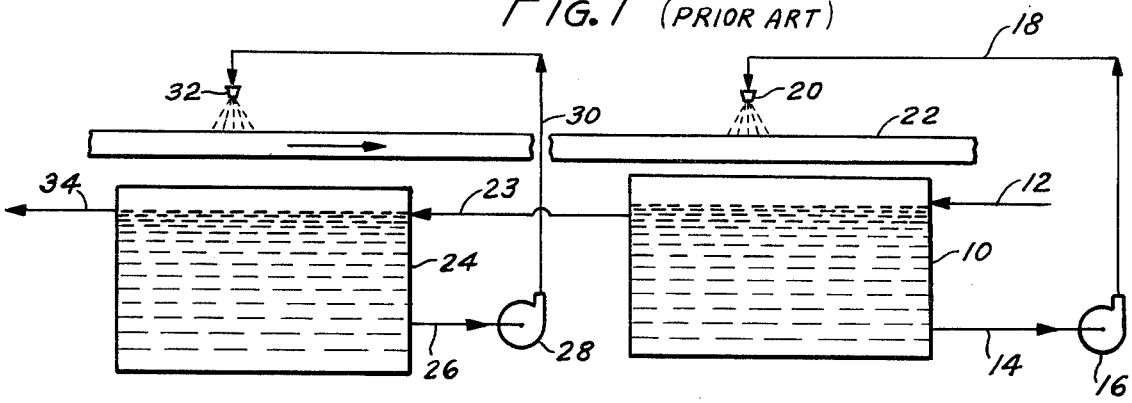
FIG. 1 (PRIOR ART)
FIG. 1 is a schematic elevation of a portion of a conventional, open tank multi-stage rinsing apparatus.

A generalized drawing of a conventional multistage rinsing apparatus is shown in FIG. 1 for purposes of explanation and comparison. Referring to FIG. 1, fresh rinse liquor is added to a final collecting tank, 10, through inlet, 12. The fresh rinse liquor mixes with liquor initially present. The mixed liquor is withdrawn from tank 10, through pipe 14, to pumping means 16, and forced by said pumping means through pipe 18 to spray head 20 where it is sprayed over a moving workpiece 22 which moves in the direction indicated by an arrow. The workpiece 22 is shown for convenience as a more or less rectangular linear member, but might be practically any object such as sheet, strip, rod, individual steel pieces such as machined or cast pieces, coils of rod or wire, or any other object either of steel or other metals or compositions which for some reason require rinsing. The liquor drains from the workpiece 22 and returns to the collecting tank 10. As an alternative in the final rinsing stage if the volume of fresh liquor is sufficient it can be routed directly to the spray head 20 from which it passes to the workpiece and then to the collecting tank 10, or can be sprayed through a separate spray head onto the workpiece with subsequent drainage to collecting tank 10.

Due to the constant inflow of fresh rinse liquor either from the inlet 12, the spray head 20, or a separate spray head, not shown, the volume of rinse liquor in tank 10 increases until it overflows through overflow pipe 23 into rinse tank 24. The liquor from tank 10 mixes with liquor already present in tank 24 and this mixture of liquors is drawn through pipe 26, to pumping means 28 and forced thereby through pipe 30 to spray head 32. In a like manner, when the volume of liquor in tank 24 reaches the level of the outlet from the tank 24, it will overflow into the next succeeding tank (not shown) through pipe 34. A similar filling, pumping, spraying and overflowing sequence occurs at each rinsing station until the liquor overflows from the initial rinse tank in the series, at which time the exiting rinse liquor is routed to disposal or treatment facilities, not shown. Thus fresh rinse liquid flows into the collecting tank in the last rinse station in which a workpiece is treated and flows from here progressively to each succeeding rinse tank until it finally reaches the rinse tank in the initial rinse station in which the workpiece is treated and finally overflows to disposal. Any required number of rinse stages can be used and in general the more stages which are used the more thorough the rinsing which is attained.

By this sequence of so-called cascade overflow, rinse liquor flows through the various tanks countercurrently to the direction of movement of the workpiece being cleaned. The workpiece is thus exposed to a series of rinse sprays, each of which contains a lesser concentration of contaminating process material. The multi-stage rinser is self regulating because the rinse liquid merely overflows from one collecting tank to the next. There is thus no chance of a tank being pumped dry no matter how fast the spray pump is operated and no sensitive control system is necessary to coordinate the spray rates of the various spray or rinse stations.

Nevertheless, by mixing the incoming liquor with the solution already present in the collecting tank, the incoming solution is rendered less pure than it would otherwise be if it was passed directly to the spray head or heads of the next succeeding rinse station. This lesser degree of purity is due to the greater concentration of process materials present in the rinse tank than in the incoming rinse liquid. However, if rinse liquid from a preceding station were passed directly to a succeeding rinse station, the preceding rinse tank could easily be drained dry unless a control system is used to limit the volume of liquor sprayed to be approximately equal to the volume of fresh rinse liquor added to the final rinse tank. Consequently, when the mixed liquor from the collecting tank is pumped to the spray heads and sprayed onto the workpiece, the degree of cleanliness of the workpiece which can be obtained in any given rinse stage is limited by the purity of the already contaminated spray rinse liquor available. By increasing the purity of the sprayed liquor, the cleaning efficiency of each stage could be improved.

Figure 2:
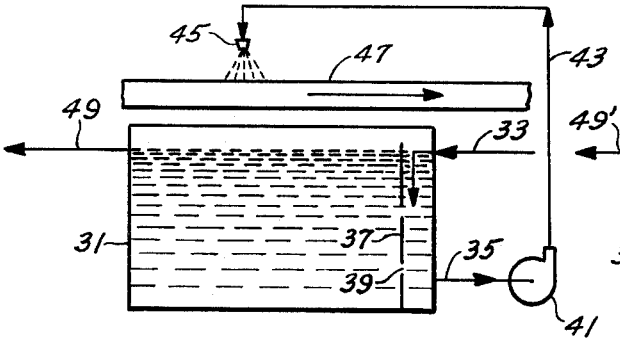
FIG. 2 is a schematic elevation of one embodiment of the improved multi-stage rinsing apparatus of the present invention.

FIG. 2 shows a modification of the conventional arrangement shown in FIG. 1 to provide one embodiment of an arrangement in accordance with the present invention. For convenience only one rinse station is shown in FIG. 2, but it will be evident that the arrangement of the invention will normally be applied to more than one rinse station. In FIG. 2 rinse liquor which has overflowed from a preceding tank enters collecting tank, 31, through inlet 33. As the liquor enters the tank 31, its flow is directed toward outlet pipe, 35, by a baffle means, 37, which has tank communicating ports, 39. Pumping means 41 withdraws liquor from tank 31, through pipe 35 and forces the liquor through pipe 43 to spray head 45. The liquor is sprayed onto the moving workpiece, 47, and subsequently returned to the tank 31. A portion of the liquor then overflows through pipe 49 into the next succeeding tank where the sequence is repeated. It will be seen that incoming rinse liquor enters the tank 31 on the opposite side of the perforated baffle 37 from where the rinse liquor enters the tank 31 from the spray head 45 so that the two flows of rinse liquor are partially separated, the degree of separation depending upon the size and number of the orifices 39 in the baffle, i.e. the degree of perforation of the baffle. The baffle means may desirably take the form of a perforated plate or the like, but various other effective baffle arrangements will occur to those skilled in the art. The baffle serves essentially to partially, but not completely, isolate the portion of the collecting tank into which the fresh rinse liquid enters from the portion of the collecting tank into which at least the major portion of the spray from the rinse spray head falls. Sufficient opening in the baffle should be provided so that enough rinse liquid may pass through the baffle to supply most of the liquid to the spray heads if necessary. The total area of opening should, however, be small enough so that the major portion of the overflow rinse liquid entering behind the baffle via the inlet 33 will be incorporated in the rinse liquor passing through the spray heads. While the workpiece 47 travels toward the baffle end of the tank, it does not normally carry any significant amount of rinse liquid along with it to the baffled section. If excessive liquid is carried by the workpiece to the baffled section of the tank the length of the tank can be increased or the baffled section can be covered by a slanting drain member.

The baffle arrangement shown and described increases the amount of incoming liquor which is drawn into the pump and forced to the spray heads. The tank communicating ports 39 in baffle 37, however, allow an amount of less pure liquor from the main portion of the tank 31 to supplement the incoming liquor supply to the extent demanded by the pump 41. In this manner, the spray head is constantly supplied with solution of greater purity than that resulting from the conventional open-tank multi-stage rinser. At the same time, however, the normal self regulating characteristic of a conventional multi-stage rinser is maintained.

Figure 3:
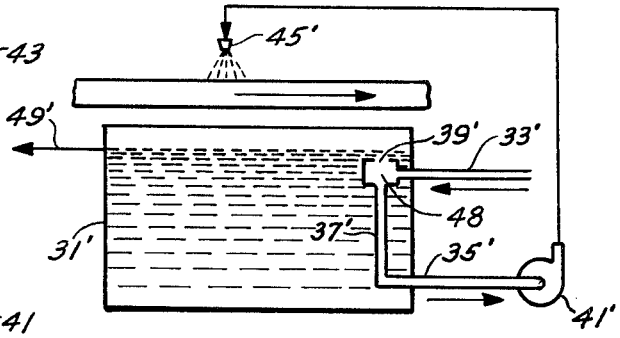
FIG. 3 is a schematic elevation of an alternative embodiment of the liquid flow deflecting baffle.

FIG. 3 shows an alternative to the liquid flow directing means or baffle arrangement of FIG. 2 in which similar numbers are used to designate similar structures with, however, the addition of an identifying prime mark to each number. Referring to FIG. 3, the liquid flow directing means comprises a liquor inlet tube 33' connected to a flow directing tube 37' which has an orifice 39' on the upper end thereof. The lower end of tube 37' is connected by an outlet tube 35' to the pumping means 41' and thence to the spray head 45'. In operation, liquor from the preceding tank flows through inlet tube 33' and is deflected by tube 37', which acts in a manner similar to the baffle 37 in FIG. 2, toward tube 35' and thence to the pump 41' which supplies the spray heads. The orifice 39', which acts in a manner similar to the perforations or orifices 39 in the baffle 37 in FIG. 2, allows liquor already present in tank 31' to supplement the incoming liquor as required by the pump. Thus no complicated control system is required to coordinate the pumping rates of the rinse stages, yet all of the fresher rinse liquid is provided to the spray heads 45'. The enlargement 48 at the intersection of the inlet tube 33' and the tube 37' serves as an expansion chamber which prevents any air from being sucked downwardly into the impellers of the pump 41'.

Figure 4:
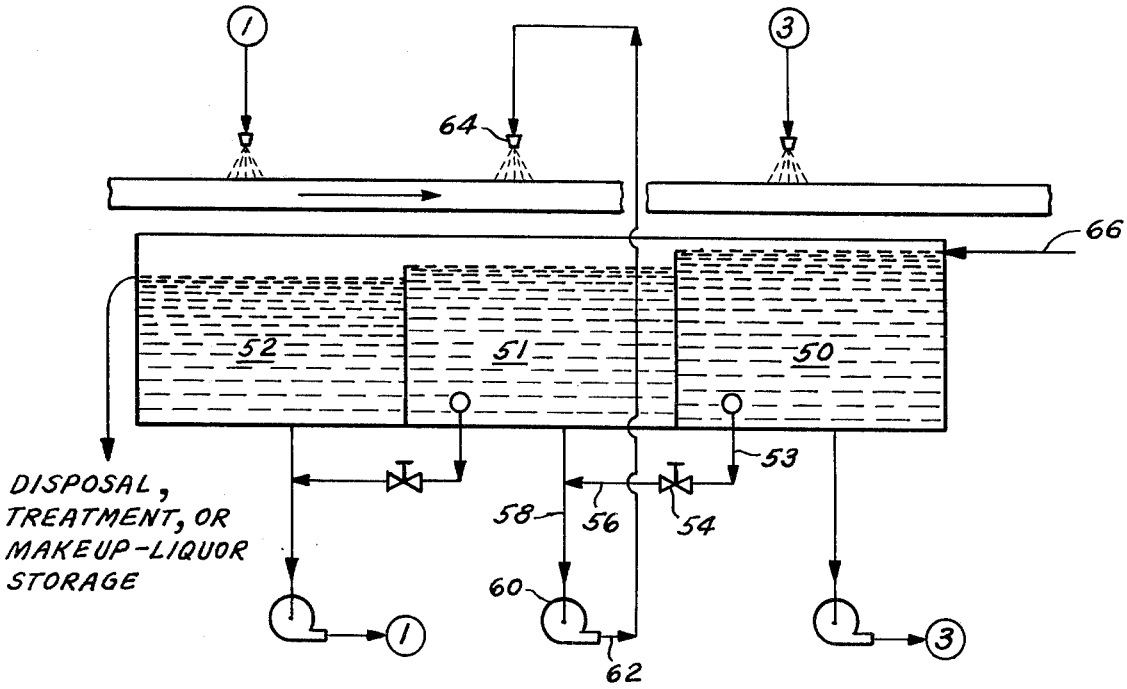
FIG. 4 is a schematic elevation of a further embodiment of the improved multi-stage rinsing apparatus.

FIG. 4 shows yet another alternative embodiment of the invention wherein liquor inlet pipes, such as pipe 23 in FIG. 1, are eliminated. Collecting tank 51 is positioned immediately adjacent both the preceding tank 50 and the succeeding collecting tank 52. Pipe means 66 supplies liquor to tank 50. Excess liquor from the preceding tank 50 cascades over the common wall into the tank 51 preferably through a notch or groove, not shown, in the common wall. Pipe means 53 connect preceding tank 50 to a flow valve 54 which in turn is connected by pipe 56 to tank drain pipe 58. Tank drain pipe 58 is connected by pumping means 60, and spray head supply pipe 62, to spray head 64. In operation, flow valve 54 is adjusted so as to regulate the relative volumes of liquor withdrawn through pipes 53 and 58 from the tanks and sent to the pump 60, and then to spray head 64.

In the embodiment of the invention shown in FIG. 4, while no complicated control arrangement need be used to coordinate the pumping or flow rates of the various rinse stages, it is necessary to regulate the opening of the various valves 54 so that at least some overflow from one rinse tank to the next will pass over the edge of adjoining tanks rather than passing through the pipes 52. If all the flow passed through the pipe 52, the particular rinse tank from which such flow is derived could, unless such flow rate is very precisely controlled, be more or less rapidly drained dry, thus seriously interfering with the even washing or rinsing cycle in the various rinse tanks.

In each of the embodiments of the invention illustrated in FIGS. 2, 3 and 4 a portion of the less contaminated rinse liquid entering the rinse station from a previous station serves to dilute a portion of the rinse liquid already present at this station. This diluted and effectively purer rinse liquid is then directed to the spray heads at the rinse station. A certain amount of dragout from the succeeding rinse station or from a prior pickling operation or the like will be present upon the surface of the workpiece passing the rinse station. As the rinse liquid from the spray heads at the rinse station is sprayed over the surface of the workpiece this dragout is partially removed from the surface of the workpiece and carried with the rinse liquid into the rinse collection tank. The amount of material removed from the surface of the workpiece will depend to a significant degree upon the purity of the rinse liquid itself. The dragout material carried on the workpiece from the rinse station will, furthermore, consist to a large extent of the rinse liquid itself plus some residual contaminating process material clinging to the surface of the workpiece. The dragout material from succeeding rinse stages and the residual contaminating process material which is removed from the surface of the workpiece will contaminate the rinse liquid which descends from the workpiece into the rinse collection tank and may for simplicity be considered as being dissolved evenly in the volume of spray liquid passing into the collection tank. This used spray liquid thus will have a relatively high concentration of contaminants, all of which pass into the collection tank. The concentration of contaminants in the spray rinse liquid passing into the rinse tank from the workpiece thus becomes essentially the concentration of contaminants in the rinse liquid in the rinse tank, except for some dilution with the rinse liquid flowing into the rinse tank directly from the previous rinse tank.

It will be seen that since the degree of cleaning in each stage is dependent in large measure upon the dilution of the rinse liquid actually flowing over the workpiece, the efficiency of cleaning in the entire rinse system will be considerably increased by the arrangement of the invention. This is because the actual rinse liquid being sprayed at each stage will be less contaminated, even though the used spray rinse liquid falling into the collecting tank from the workpiece at each stage may be more contaminated than in prior art arrangements. Such increased contamination of the liquid passing from the workpiece into the rinse tank will be particularly notable if the increased efficiency of the system of the invention is taken advantage of by decreasing the flow of fresh rinse liquid through the system. However, if the same or an increased amount of fresh rinse liquid is used to obtain increased cleanliness of the rinse piece, the actual contamination of the rinse liquid may be proportionately less. As a practical matter under modern conditions where it may be necessary to treat the rinse water for reuse or disposal rather than simply dumping it into the environment, it may actually be an advantage for the waste rinse liquor from the final rinse to be as concentrated as possible, since it may then be more efficiently treated for removal of the process material contaminating it. In some situations the volume of the final rinse water may be sufficiently concentrated and/or sufficiently reduced in volume by the multi-stage rinsing described herein that it may be entirely consumed as make-up liquid, for example, in a pickling operation, thus eliminating the need for a rinse liquor treatment facility and also permitting recovery of free acid units in the final rinse liquid.

While a portion of the rinse liquid from any given operation or stage of a spray rinsing operation which operates in accordance with the present invention will always be mixed prior to use in the associated spray heads with at least a portion of rinse liquid from a previous stage, it will usually be advantageous to use as much fresh liquid from the previous stage or operation as possible. The most efficient amount can be determined for any given operation by calculation or experiment. Thus if, for example, there are 10 gallons per minute of fresh rinse liquid available as excess overflow from the prior stage it may be more desirable to circulate a total of 20 gallons per minute or even less through the spray heads of the particular stage rather than 100 gallons per minute, because the smaller amount of circulating rinse liquid will be proportionately purer or less contaminated than a larger amount and thus may have greater rinsing effectiveness even though there is less total rinse liquid contacting the workpiece. A greater inflow of fresh liquid, furthermore, will tend to decrease the buildup of contaminants in the rinse liquid in the rinse tank of the particular stage.

The rinse medium has been referred to broadly herein generally as the rinse liquid or rinse liquor. It will be readily understood by those skilled in the art, however, that the rinse liquid will usually be water. However, the arrangement of the invention will also be applicable to the use of other rinse liquids such as, for example, various possible organic solvents.

Thus, by the use, in at least some spray operations conducted in a multi-stage spray rinsing apparatus, of at least a portion of spray liquid from a previous spray operation mixed with spray liquid from the particular spray operation, it is possible to obtain a more effective and efficient spray rinse operation. Such spray operation will either more effectively rinse a workpiece with the same total spray liquid flow through the operation, i.e., through the particular stage from inlet to outlet, or will obtain the same rinsing efficiency or the same cleanliness of the workpiece with the use of less total throughput of rinse liquid, or a combination of both.

The basic invention resides in increasing the proportion of liquor from a previous rinsing station used in the makeup of rinse liquid sprayed onto a workpiece at the next rinse station over that which would normally be present in a conventional multi-stage rinsing operation. The fresh or less contaminated rinse liquid from the preceding rinse tank dilutes the impurities in the rinse liquid drawn from the rinse collecting tank of the particular rinse stage and thus adds cleanliness to the liquid issuing from the sprays at that stage. It is this increased cleanliness of the spray rinse liquid which accomplishes the results of the invention.

While no details of the spray heads used at the various rinse stations have been shown, it will be understood that various types of spray heads can be used such as shower type heads, ring and donut shaped heads which completely or partially surround the workpieces as they pass the spray heads, and various other types of spray heads.

We claim:

1. An improved method of rinsing workpieces wherein said workpieces are subjected to a multiplicity of spray rinsing operations in a spray rinse system and rinse liquor from a preceding rinse operation is transferred to a succeeding spray rinse operation, the improvement comprising:

combining rinse liquor from a preceding spray rinse operation with a minor proportion of rinse liquor from the next succeeding spray rinse operation and spraying the mixture onto a workpiece being conveyed through the spray rinsing system at a location from which the used spray rinse liquor will flow into said next succeeding spray rinse operation.

2. In a continuous multi-stage rinsing apparatus comprising a multiplicity of discrete rinsing stations each of which stations comprises a collecting tank, a pump means, a liquid conduit means connecting said collecting tank to said pump means, spray head means disposed above said collecting tank, pipe means connecting said spray head means to said pump means, a liquid inlet means and a liquid outlet means connecting said collecting tank to adjacent collecting tanks, the improvement comprising:

a liquid flow directing means disposed within at least one of said collecting tanks so constructed and arranged that liquid entering said collecting tank from a preceding collecting tank is deflected toward said liquid conduit means prior to combining of said liquid from said preceding collecting tank with liquid from the said collecting tank.

3. In an improved method of multiple stage spray rinsing of a workpiece in which the workpiece is passed through consecutive spray stages of rinse liquid, the sprays of each stage being drawn from and discharged to a collecting means which is one of a series of connected collecting means and in which rinse liquid is introduced into an initial rinse stage and passed consecutively from one rinse stage to the next countercurrently to the passage of the workpiece through the rinse stages until discharged from a final rinse stage, the improvement comprising routing, in at least one of said stages, a substantial portion of rinse liquid drawn from the collecting means of a preceding stage directly to the sprays of said one of said stages along with a portion of rinse liquid drawn from the collecting means of said one of said stages.

4. An improvement in a multiple stage spray rinsing apparatus in which a workpiece is passed through consecutive sprays of rinse liquid derived from spray means, the rinse liquid passing through the spray means of each stage being drawn from and discharged into an open-top collecting means which is one of a series of connected collecting means, and in which fresh rinse liquid is introduced into an initial rinse stage and passed consecutively from one rinse stage to the next countercurrently to the passage of the workpiece through the rinse stages until discharged from a final rinse stage comprising rinse liquid flow directing means associated with at least one of said collecting means in one of said stages arranged and constructed to direct a substantial portion of rinse liquid derived from a preceding collecting means and a portion of rinse liquid derived from said one of said collecting means directly to the spray means of said one of said stages.

5. In an improved multi-stage rinse apparatus including:

a. a rinse tank for receiving and containing rinse liquid, b. spray means positioned over the rinse tank for spraying rinse liquid upon a workpiece, c. pumping means for pumping rinse liquid from the rinse tank to the spray means, and d. means to introduce fresher rinse liquid into the the rinse tank, the improvement comprising:

e. means to combine at least a substantial portion of the fresher rinse liquid with a minor proportion of rinse liquid from the rinse tank and direct the combined liquid to the spray means.

* * * * *